United States Patent [19]

Altschul

[11] 4,429,429

[45] Feb. 7, 1984

[54] DEVICE FOR CLEANING SWIMMING POOL SIDEWALL

[76] Inventor: Rod H. Altschul, 53 Countryside Rd., Newton Centre, Mass. 02159

[21] Appl. No.: 292,159

[22] Filed: Aug. 12, 1981

[51] Int. Cl.[3] ..... E04H 3/20

[52] U.S. Cl. ..... 15/50 R; 15/1.7; 134/167 R

[58] Field of Search ..... 15/1.7, 21 R, 49 R, 15/50 R; 134/167 R, 168 R; 114/222

[56] References Cited

U.S. PATENT DOCUMENTS

| | | | |
|---|---|---|---|
| 1,466,315 | 8/1923 | Thorsen | 15/1.7 |
| 3,295,540 | 1/1967 | Ortega | 134/167 R |
| 3,315,692 | 4/1967 | Arneson | 134/167 R |
| 4,129,904 | 12/1978 | Pansini | 15/1.7 |

FOREIGN PATENT DOCUMENTS

| | | | |
|---|---|---|---|
| 2023593 | 11/1971 | Fed. Rep. of Germany | 15/1.7 |
| 2138194 | 3/1973 | Fed. Rep. of Germany | 15/1.7 |
| 584029 | 1/1947 | United Kingdom | 15/1.7 |

*Primary Examiner*—Edward L. Roberts

*Attorney, Agent, or Firm*—Wolf, Greenfield & Sacks

[57] ABSTRACT

A device for cleaning the sidewalls of a swimming pool at the waterline region is self-propelled by water jets which also urge the device against the pool sidewall. The device includes brushes which brush against and clean the sidewall of the swimming pool as the device advances through the water. Means are provided for squirting a cleaning agent against the tiles. In one embodiment, means also are provided for collecting debris and dirt loosened by the brushes.

33 Claims, 14 Drawing Figures

DEVICE FOR CLEANING SWIMMING POOL SIDEWALL

BACKGROUND OF THE INVENTION

1. Field of the Invention

This invention relates to a device for cleaning the sidewalls of a swimming pool in the waterline region, within a few inches above and below the waterline. More specifically, a brush means or the like positioned on the pool cleaning device wipes the tiles of the pool at the waterline region. The pool cleaning device is self-propelled along the pool walls by a water jet system connected to a source of water under pressure. The water jet system aces in conjunction with floatation means to facilitate motion of the pool cleaning device at the waterline so that the brush means is partially above the waterline. In addition, the device has an automatic soap dispensing means for use in conjunction with the brush means. The device is designed to be capable of turning corners to follow the sidewall surfaces of the pool. The water jet system is also utilized in one embodiment of the invention in a system for trapping dirt and debris removed from the tiles by the brush means. A swimming pool ladder guard and a skimmer bypass grate, both specially adapted for use with the device, afford the device unimpaired travel along the swimming pool sidewalls.

2. Description of the Prior Art

Devices for cleaning swimming pools typically have been designed to remove loose debris which sinks to the bottom of the pool, floats on the water surface, or circulates through the water of the pool. While a few vcuum-like devices have been designed to travel along the bottom and lower region of the pool sidewall surfaces, there is no device which is able to clean the upper portions of the pool sidewalls in the waterline region. Typically, the tiles which extend along the upper portion of a swimming pool must be cleaned periodically by hand using cleaing agents and stiff brushes to remove the grime which tends to build up along the waterline tiles.

SUMMARY OF THE INVENTION

It is among the primary objects of the invention to provide a device adapted to clean the sidewalls of a swimming pool at the waterline region.

More specifically, it is an object of the invention to provide a device which is self-propelled to travel along the sidewalls of a swimming pool at the waterline region.

A further object of the invention is to provide a system for cleaning swimming pool sidewalls at the waterline region which has the capability of turning corners and following the contours of the sidewalls.

Another object of the invention is to provide a device which automatically dispenses soap solution to more efficiently clean the sidewall surfaces of a swimming pool at the waterline region, and which has the further capability of rinsing the soap solution from the sidewall surfaces.

An additional object of the invention is to provide a device of the type described which has the further capability of collecting the dirt removed by the device.

The swimming pool tile cleaning device of the present invention comprises water jet propulsion means, cleaning means, floatation means, water inlet means, and soap-dispensing means. The water inlet means is connected by a floating hose to a source of water under pressure, preferably the pool's water inlet fitting.

The cleaning means is preferrably a brush portion which has a curved surface at the leading end, but otherwise has a substantially planar surface. The brush wipes against the sides of the pool as the device advances. The curved brush portion helps the device to initiate turns in the corners of the pool.

The soap-dispensing means is in communication with the water inlet means and includes a soap chamber, which is filled with a concentrated cleaning agent such as soap. Water mixes with the cleaning agent to form a solution which flows to a soap dispenser, which squirts the solution against the swimming pool sidewall near the leading end of the brush means.

The device comprises two or more water propulsion jets, which propel the device in a forward direction while urging it against the swimming pool sidewall. The device also includes floatation material which affords sufficient buoyancy to maintain the device at the proper level in the water, about two to three inches above the waterline as it travels along the sidewalls.

In one embodiment, the present invention also includes a dirt collection means. This embodiment comprises a leading portion which carries the brush and trailing portion which carries the dirt collectors. The leading and trailing portions are joined together by a flexible connecting means so that the device can bend easily and follow the curved contours and corners of the pool. The leading portion also houses the soap-dispensing means. The trailing portion houses the dirt collection filter, the soap chamber, and water inlet fitting. The flexible connection between flexible hoses which carry pressurized water and soap solution from the trailing means to the leading portion.

Floatation means and water jet propulsion means are located on each of the leading and trailing portions. One of the water jets on the trailing portion has the further function of directing a water flow to the collection filter to create suction action to ingest dirt loosened by the cleaning means into a removable filter bag inside the collection means.

In another embodiment of the invention, the dirt collection means and trailing portion are omitted, with all propulsion and guidance jets being carried by a single unit which also carries the brush elements as well as the mixing chamber and dispensing element for the cleaning agent.

BRIEF DESCRIPTION OF THE DRAWINGS

The foregoing and other objects and advantages of the invention will be appreciated more fully from the following further description thereof, with reference to the accompanying drawings wherein.

DETAILED DESCRIPTION OF EMBODIMENT I

Figure 1:
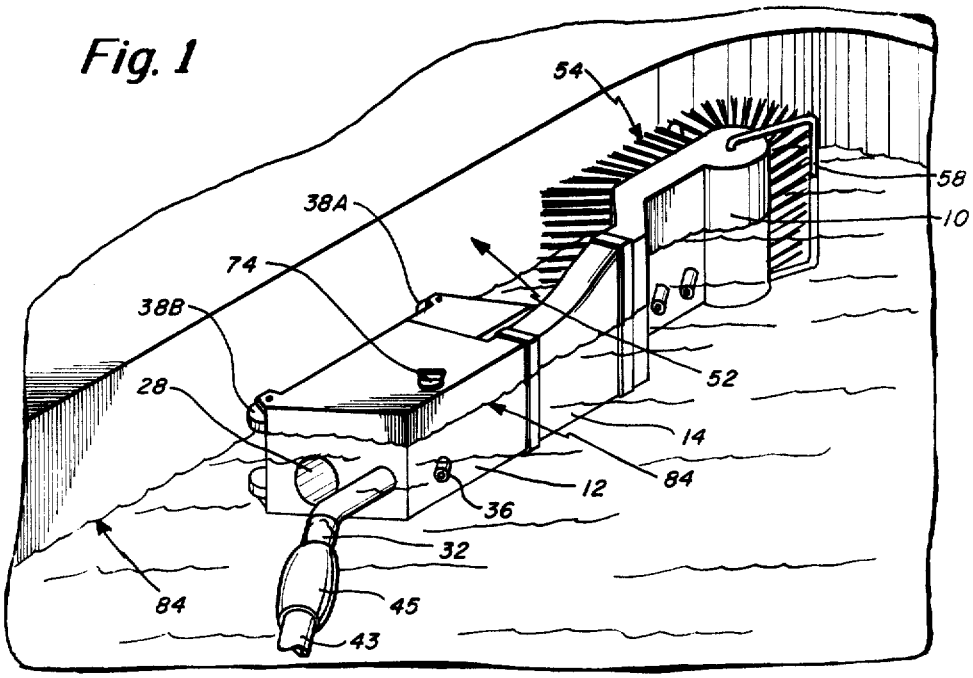
FIG. 1 is a somewhat diagramatic perspective view showing one embodiment of the pool cleaning device as it appears in use travelling along the pool sidewall partially above the waterline.
Figure 2:
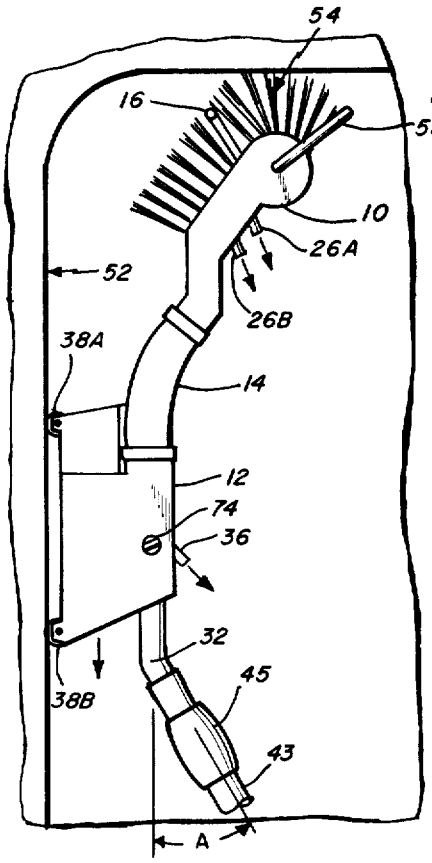
FIG. 2 is a somewhat diagrammatic top view of the device shown in FIG. 1 partially flexed position as it turns a corner along the pool sidewall.

FIGS. 1-6 illustrate one embodiment of the present invention. As shown best in FIGS. 1 and 4, the device includes a leading portion 10 and a trailing portion 12 which are connected together by a flexible connecting means 14. The leading portion 10 includes a flat brush portion 22 and a curved brush portion 24, a soap dispenser 16, and water propulsion jets 26A and 26B. The trailing portion 12 includes a collection chamber 28 to house a filter, elongated water propulsion jet 30, main inlet tube 32, soap chamber 34, water propulsion jet 36, leading wheels 38A, and trailing wheels 38B. The flexible connecting means 14 includes a soap solution inlet hose 40, a water inlet hose 42, and flexible covering 44.

The leading portion 10 has a flat portion 46 extending longitudinally of the device, a curved portion 48 at its forwardmost end, and an angled portion 50 which extends from the flat portion 46 to the flexible connecting means 14. A plurality of long flexible bristles 54 are supported by the flat casing portion 46 on the side of the device which is to come in contact with the swimming pool sidewall 52, thus forming a flat brush portion 22. A plurality of long flexible bristles 54 is also supported by the front and side of the cylindrical casing portion 48 forming a curved brush portion 24 adjacent to the flat brush portion 22.

Figure 3:
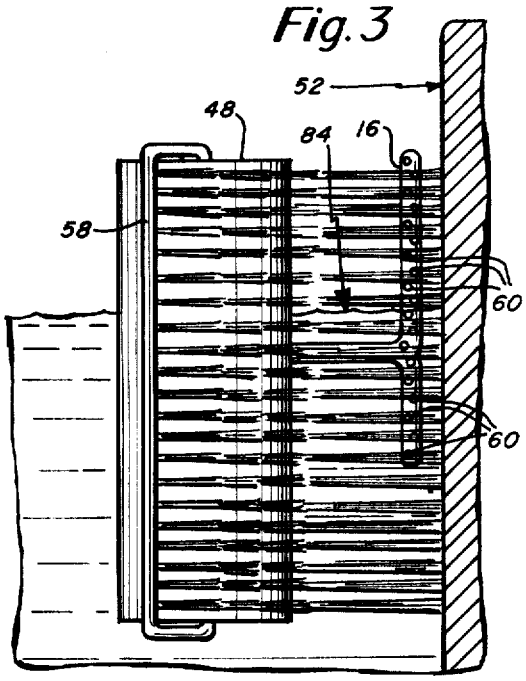
FIG. 3 is a front view of the leading portion of the device shown in FIG. showing the brush and soap dispenser.
Figures 4, 5, 6:
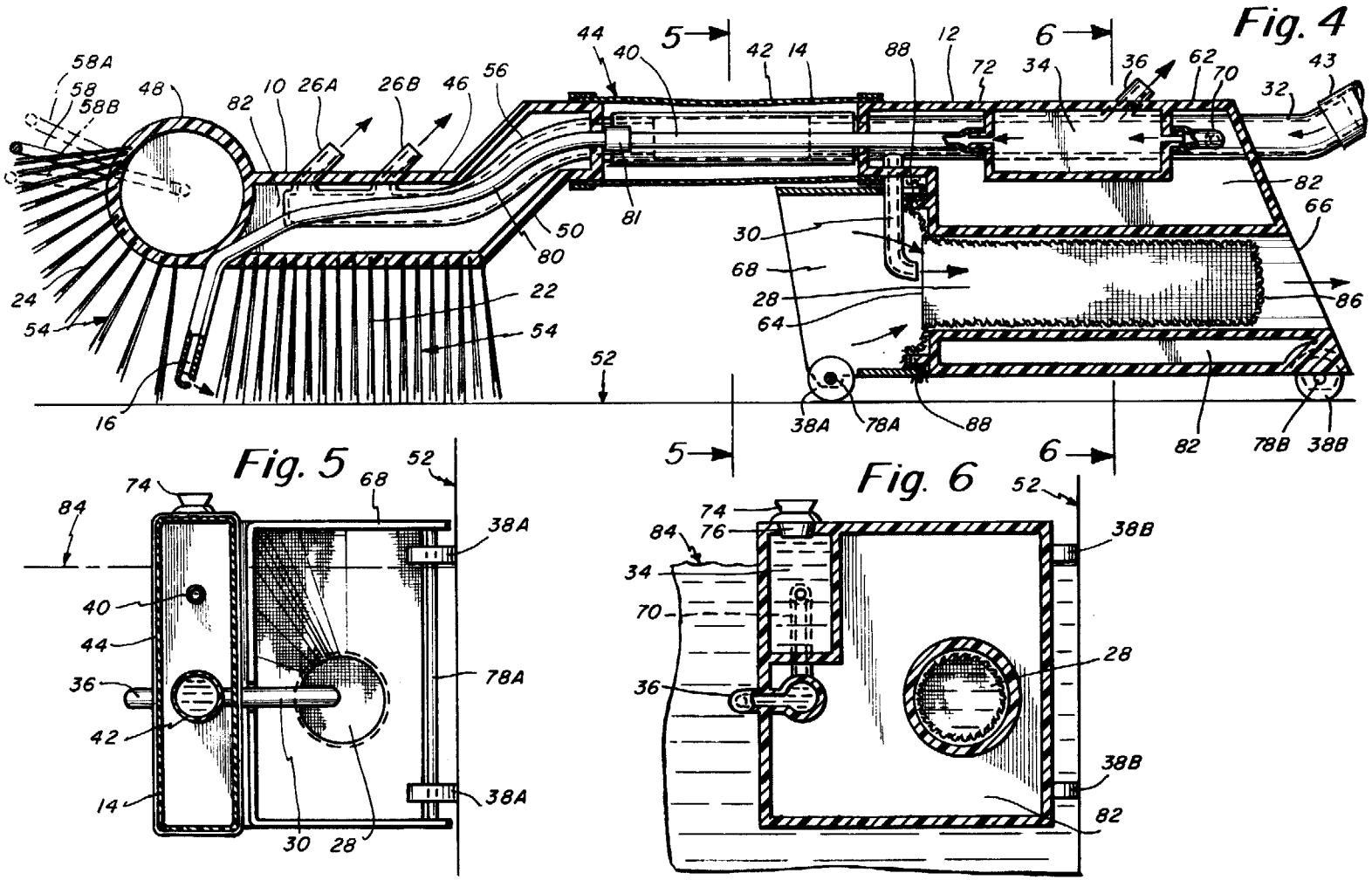
FIG. 4 is a plan cross-sectional illustration of the device.
FIG. 5 is a view in cross-section taken along line 5—5 of FIG. 4.
FIG. 6 is a view in cross-section taken along line 6—6 of FIG. 4.

Water jets 26A and 26B are positioned on the leading portion 10 of the device, on the side of the flat casing portion 46 opposite that of the flat brush portion 22. The water propulsion jets 26A and 27B are in communication with a water jet feed tube 56, which extends to the outside of the rear of the leading portion 10. A "T"-shaped soap solution dispenser 16 having a plurality of holes 60 extends from the leading portion 10 at the region where the curved brush portion 24 and the flat brush portion 22 merge. The base of the "T" extends from the casing to position the dispenser 16 slightly inward of the ends of the bristles 54, as shown in FIG. 3.

A bumper 58 may be provided to prevent the bristles of the brush from catching on any tiles. The bumper preferably is affixed to the leading portion 10 and extends outwardly beyond the leading edge of the curved brush portion 24. The bumper 58 bends at a 90° past the ends of the bristles 54 to extend perpendicular to the bristles 54 of the curved brush portion 24, as shown in FIG. 3. The bumper 58 preferably is mounted to the leading portion 10 in a manner which will enable the position of the bumper 58, with respect to the brush, to be adjusted to various positions as suggested in phantom at the positions indicated at 58A, 58B in FIG. 4. The angular adjustment feature for the bumper 58 to be oriented to accommodate unusually shaped pools having unusual corner arrangements which, in the absence of a properly located bumper 58, might enable the leading bristles to catch on the pool sidewall.

The trailing portion 12 comprises a casing 62 with a main inlet tube 32 to be connected to a source of water under pressure by means of a long, flexible floating hose. The main inlet tube 32 extends through the length of the casing 62 and protrudes outside the rear end of the casing 62. The inlet tube 32 is bent outward at an angle A sufficient to prevent the hose trailing behing the device from pulling the trailing portion 12 away from the sidewall 52 (see FIG. 2). The rear face of the casing 62 slants at an acute angle to the swimming pool sidewall 52 to reduce drag as the trailing means travels through the water.

The main inlet tube 32 is connected to a source of water under pressure by a hose 43 which is connected to the water inlet fitting of the swimming pool. The hose 43 has one or more floats 45 which keep the hose 43 afloat so as not to drag downwardly on the device.

A generally cylindrical collection filter chamber 28 is housed in the trailing portion 12. The collection chamber entrance 64 and collection chamber exit 66 are located at the forward and rear ends of the collection chamber 28, respectively, to permit the free flow of water therethrough. The collection chamber 28 is positioned in the trailing portion 12 to be rearward of the bristles 54 of the leading portion 10 when the pool cleaner is traveling against a flat swimming pool sidewall 52. A collar portion 88 extends forward of the chamber 28 to accomodate a porous filtration bag 86 which fits over the collar portion 88 and trails inside the chamber 28. A detachable chamber 68 fits over the collar 88 and is open at its front and rear faces. The chamber sleeve 68 engages over the collar 88 to secure the filtration bag 86.

A soap chamber 34 is located within the trailing portion 12 for storing a concentrated cleaning agent such as soap. A removable cap 74 seals the soap chamber opening 76 through which the soap chamber 34 may be filled with concentrated soap or the like. (See FIG. 6). The soap chamber 34 receives water from an inlet tube 70 which is in communication with the main inlet tube 32. The soap and water mix in the chamber and the mixture passes through the outlet tube 72 which extends from the soap chamber to the forward end of the trailing portion. From there, the mixture travels through the soap solution hose 40 to the leading portion 10, where the mixture is fed from the soap solution feed tube 80 to the soap dispenser 16 which emits the mixture toward the swimming pool sidewall 52.

A water propulsion jet 36 is located on the side of the trailing portion 12 which is opposite the side facing the swimming pool sidewall 52 when the pool cleaner is in use. An elongated water propulsion jet 30 is located forward of the filtration chamber entrance 64. Both water propulsion jet 36 and elongated water propulsion jet 30 are in communication with the main inlet tube 32. The filtration chamber sleeve 68 has a cut-away portion so that the elongated water propulsion jet 30 does not obstruct the fitting of the sleeve 68 over the forward end of the collection chamber 28.

A leading wheel set comprised of two wheels 38A mounted on an axle 78A is supported at the front end of the filtration chamber sleeve 68. A trailing wheel set comprised of two wheels 38B mounted on an axle 78B is supported at the rear end of the trailing portion casing 62. The wheel sets are located on the side of the trailing portion 12 which faces the swimming pool sidewall 52 when the pool cleaner is in use. The wheel sets reduce drag of the trailing portion 12 while preventing damage to the trailing portion as it travels along the sidewalls.

The flexible connecting means 14 comprises a flexible water inlet hose 42. One end of the water inlet hose 42 is connected to the forward end of the main inlet tube 32 of the trailing portion 12. The other end of the water inlet hose 42 is connected to the rearward end of the water jet feed tube 56 of the leading portion 10. The flexible connecting means 14 also comprises a flexible soap solution inlet hose 40. One end of the soap solution inlet hose 40 is connected to the soap chamber outlet tube 72 of the trailing portion 12, and the other end is connected at 81 to the rearward end of the soap solution feed tube 80 of the leading portion 10. The flexible covering 44 may be a flexible sleeve which encases the water inlet hose 42 and soap solution inlet hose 40. The flexible covering 44 is attached at one end to the leading portion 10 and at the other end to the trailing portion 12 (See FIG. 5). The flexible connecting means 14 provides a bendable center portion of the device to allow the leading portion 10 to move angularly in relation to the trailing portion 12 as the device follows the contours of the swimming pool.

Floatation material 82 fills a portion of the hollow regions of the casings of the leading portion 10 and the trailing portion 12. The floatation material is arranged so that the pool cleaning device will float at the waterline region and remains balanced to effectively travel along the sidewalls of the pool during use. The bottommost portions of the leading and trailing portions 10 and 12 remain hollow and the casings in those regions have a plurality of water flow holes which permit water to fill those regions when the pool cleaning device is immersed, thus providing a weight balance within the device to help maintain it in its proper position during use.

To operate the device, the main inlet tube 32 is connected to long floating hose sufficient to allow the device to reach all parts of the swimming pool sidewalls at the waterline. Once the device is connected to the water source, some of the water travelling into the main inlet tube 32 is fed to the water propulsion jet 36 and elongated water propulsion jet 30 in the trailing portion 12. Water also travels through the length of the main inlet tube 32 to the water inlet hose 42 of the flexible connecting means 14. From there, the water travels through the water jet feed tube 56 of the leading portion 10 and exits through the two water propulsion jets 26A and 26B. The force of the water rushing out of the water propulsion jets propels the pool cleaner in a forward direction while urging the device against the sidewall 52 of the swimming pool. Water jets 26A, 26B, and 36 are aimed toward the rear of the device and away from the sidewall of the swimming pool, and elongated water propulsion jet 30 is aimed directly toward the rear of the device; thus, the device is propelled in the opposite direction of the flow of water through the jets.

Water jets 26A, 26B and 36 preferably are swivel-type jets which may be adjusted to alter the position of travel of the device, there varying the propulsion and scrubbing characteristics of the device, should that be desired. For example, the jets can be adjusted to vary propulsion speed, scrubbing force of the brushes, and the like.

The floatation material 82 maintains the device in a balanced position with the flat brush portion 22, the leading wheels 38A and the trailing wheels 38B all travelling along the tiles of the swimming pool sidewall 52. The floatation material 82 also provides sufficient buoyancy to maintain the top edge of the leading portion 10 of the device at least about two inches above the waterline 84, so that the flat and curved brush portions 22 and 24 can clean the swimming pool tiles above the waterline 84 where the tiles are most soiled. (See FIG. 1.). Thus, when the device is connected to the water source, it is self-propelled to travel along the swimming pool sidewalls and remains afloat at the waterline region while maintaining contact with the swimming pool sidewall.

The water flow through the elongated water propulsion jet 30 is directed rearward through the filtration chamber 28. Thus, not only does the flow from the elongated water propulsion jet 30 assist in propelling the device in a forward direction, it also creates a suction effect as the device travels through the water whereby water tends to be drawn into the filtration chamber 28 through the filtration chamber entrance 64 and out the filtration chamber exit 66. Since the filtration chamber entrance 64 is located rearwardly of the brush portions 22 and 24, the dirt which is removed from the sidewall 52 by the bristles 54 can wash into the filtration chamber 28 where the dirt may be filtered from the water by the filtration bag 86.

Some of the water flowing through the main inlet tube 32 is diverted to the soap chamber inlet tube 70 and into the soap chamber 34, where it mixes with concentrated soap to form a soap solution. The soap solution travels out of the soap chamber 34 through the soap chamber outlet tube 72 and flows into the soap solution inlet hose 40 of the flexible connecting means 14. From there, the soap solution travels through the soap solution feed tube 80 of the leading portion 10 and exits through the holes 60 of the dispenser 16. Thus, cleaning solution is dispensed to the tiles of the swimming pool sidewall 52 in the region between the bristles 54 of the brush portions 22 and 24. It should be noted that the soap dispensing system in this invention incorporates a self-rinsing function so that after all of the soap or cleaning agent has been mixed and dispensed, the device will continue to emit clean water from the dispenser 16. Thus, the device can then be used to rinse residual soap solution from the tiles above the waterline 84 after the device has gone through one or more cycles using the soap.

As the device travels along a sidewall, the leading wheels 38A and trailing wheels 38B facilitate the smooth travel of the trailing portion 12 while the bristles 54 of the leading portion 10 brush against the sidewall 52. When the device reaches a corner of the swimming pool, the curved brush portion 24 guides the leading portion 10 around the corner and the flexible connecting means 14 beads at an angle so that the trailing portion 12 can follow the leading porton 10 around the corner (see FIG. 2). The bumper 58 assists in guiding the leading means around the corner to prevent bristles from catching on the tiles. It should be noted that the present invention will turn and flex to advance along inside (concave) corners and curves as well as outside (convex) sidewall configurations.

Figure 7:
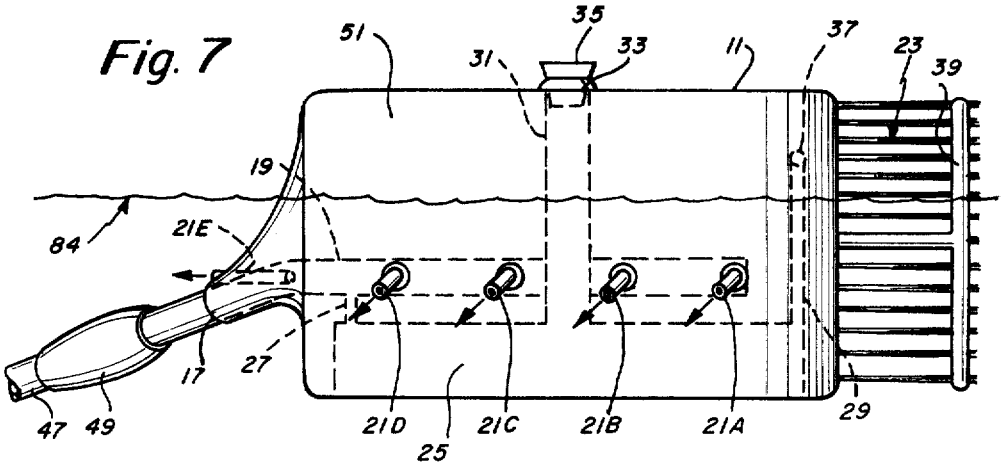
FIG. 7 is a somewhat diagramatic side view of another, simplified embodiment of the device in partial cross-section.
Figure 8:
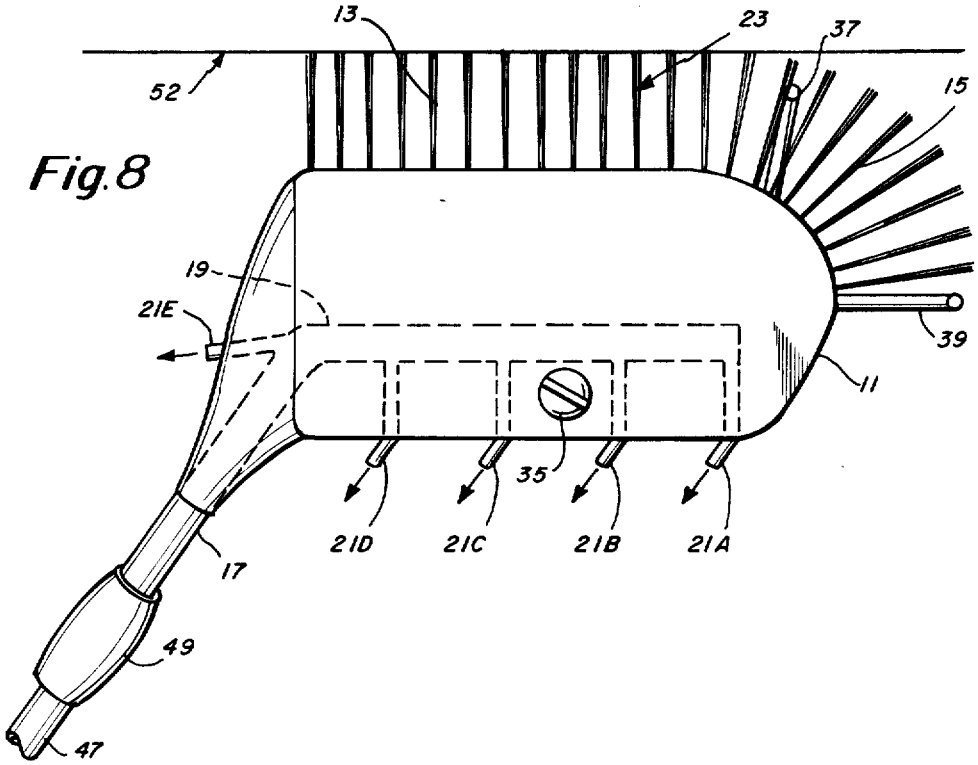
FIG. 8 is a somewhat diagramatic top view of the device shown in FIG. 7.

Another embodiment of the swimming pool tile cleaner of the present invention is shown in FIGS. 7 and 8. The device comprises a casing 11 which houses a cleaning means, propulsion means, floatation means, and soap dispensing means. The device also includes a water inlet means to be connected to a source of water under pressure.

The cleaning means is a brush means comprised of a plurality of long, flexible bristles 23 which form a flat brush portion 13 and a curved brush portion 15. The flat brush portion 13 scrubs the sidewall of the pool as the device travels around the pool, and the curved brush portion 15 allows the device to turn corners of the pool sidewall. A T-shaped bumper 39 extends from the casing 11 at the leading edge of the curved brush portion 15. The bumper 39 which may be adjustably positioned as described in connection with the previous embodiment, assists the device to follow the contours of the swimming pool sidewall without catching.

The water inlet 17 of the device is connected to a water jet feed tube 19 inside the device. A plurality of water propulsion jets 21A–21E are in communication with the water jet feed tube 19. As illustrated, one of the jets 21E is located at the rear end of the device, the other jets 21A–21D being located at the back face of the device. The water propulsion jets 21A–21E are adjustable and are oriented to propel the device in a forward direction while at the same time urging it against the swimming pool sidewall 52.

The water inlet 17 is connected to a source of water under pressure by a hose 47 which extends to the water source of the swimming pool. The hose 47 has one or more hose floats 49 which keep the hose 47 afloat to reduce drag as the device travels along the sidewall 52.

A soap chamber 25, located in the lower portion of the casing 11, contains a concentrated cleaning agent such as soap. The soap chamber 25 communicates with the water jet feed tube 19 by a soap chamber inlet 27. Water entering the soap chamber 25 through the water jet feed tube 19 mixes with the cleaning agent to form a solution which flows out of the chamber through the soap chamber outlet 29. From there, the solution flows to the soap dispenser 37, a T-shaped tubular member similar to the soap dispenser of the previously described embodiment which is positioned between the flat brush portion 13 and the curved brush portion 15. The solution is thereby dispensed by the soap dispenser 37 toward the swimming pool sidewall 52. The soap chamber is filled with cleaning agent through the soap chamber fill tube 31 which has an opening 33 with a removable cap 35.

The casing 11 contains floatation material 51 which provides sufficient buoyancy to keep the device afloat so that the brush portions 13 and 15 extend at least two inches above the waterline 84 as the device travels along the swimming pool sidewall.

The foregoing detailed descriptions are illustrative of two embodiments of the present invention as a device and method for cleaning the sidewalls of a swimming pool at the waterline region. The self-propelled pool cleaner is powered by water jets and is designed to remain afloat at the waterline region. The device travels along the swimming pool sidewalls as the scrubbing means scrubs the sidewalls in the waterline region including at least two inches above the waterline. The soap dispensing means operates automatically in conjunction with the propulsion of the device by the water jet system. In both of the described embodiments, the device is capable of turning corners and of following the contours of the swimming pool sidewalls.

In order to facilitate operation of the swimming pool tile cleaning device, the the pool may be provided with a skimmer bypass grate and a swimming pool ladder guard, both of which are described below in further detail.

Figure 12:
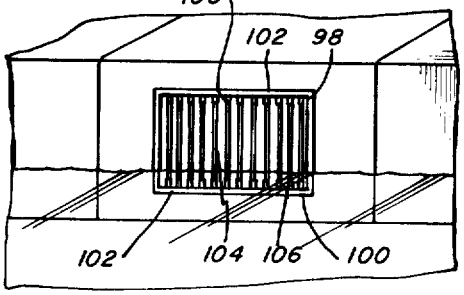
FIG. 12 is a front perspective view of a skimmer bypass grate which may be used with the present invention.
Figure 13:
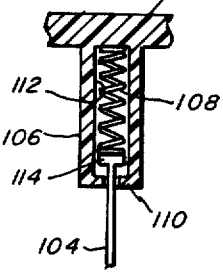
FIG. 13 is a side expanded view in partial cross-section of a spring mount of the skimmer bypass grate.

A skimmer bypass grate 98 fits over the skimmer opening 100 of the swimming pool to afford the pool cleaning device of the present invention unimpaired travel past the skimmer opening 100. The grate 98 comprises a flame 102 adapted to fit the skimmer opening 100, as shown in FIG. 12. The grate 98 is slightly larger in vertical dimension than the skimmer opening 100 The frame 102 comprises top and bottom horizontal members which support a plurality of vertical bars 104. The bars 104 are supported by spring mounts 106 affixed to the frame 102. Each spring mount 106 comprises a spring chamber 112 which houses a spring means 108, as shown in FIG. 13. The vertical bar 104 has a wide, substantially flat head 114 which is seated in the spring chamber 112 between the spring means 108 and the constricted spring mount opening 110. When the frame 102 is compressed in a vertical direction, the head 114 of each vertical bar 104 compresses the spring means 108, thereby facilitating vertical contraction of the grate 98 for placement in the skimmer opening 100. Once in place, the grate 98 fits sungly in the opening when released. The bars 104 function not only to allow the pool cleaning device to bypass the skimmer opening 100 but also to scrape off and dislodge dirt which may be accumulated on the brush portions of the device. It is preferred to dislodge the dirt near the skimmer which can clear it away quickly, particularly when the filterless embodiment of the invention is used.

Figure 9:
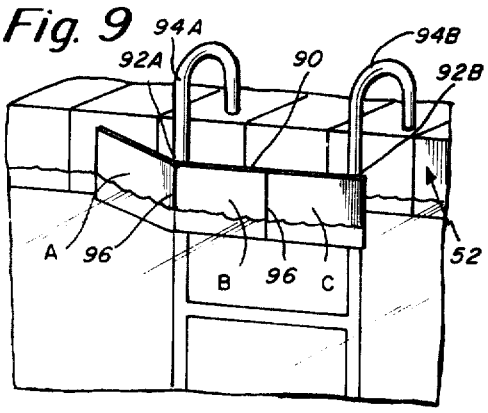
FIG. 9 is a front perspective view of a ladder guard which may be used with the present invention.
Figure 10:
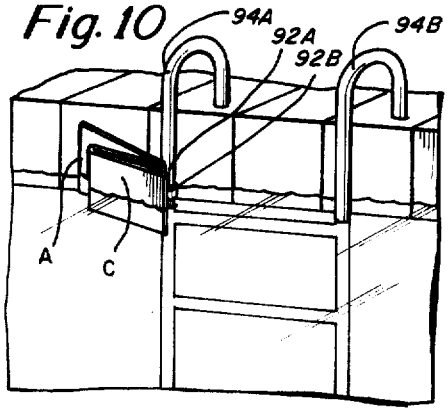
FIG. 10 is a front perspective view of the ladder guard in retracted storage position.
Figure 11:
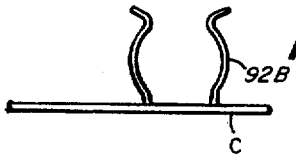
FIG. 11 is a top expanded view of a curved clip of the ladder guard.

A separate ladder guide 90 is attached to the swimming pool ladder to permit the swimming pool tile cleaner to travel around the ladder and continue on its way along the swimming pool sidewall 52. The ladder guard 90 is comprised of three sections, as shown in FIG. 9. The adjacent sections are joined by hinge means 96. Curved clip 92A and is attached at the juncture of sections A and B, and curved clip 92B is attached at the unhinged side edge of section C. An enlarged view of the curved clip is shown in FIG. 11. The clips 92A and 92B fit snugly over the ladder poles 94A and 94B so that sections B and C extend across the front of the ladder and section A extends from ladder pole 94A to the swimming pool sidewall 52. As the swimming pool tile cleaner travels to the ladder, it is guided up the ramp formed by section A and over sections B and C. Then the device resumes travel along the swimming pool sidewall 52. The ladder guard 90 may be folded out of the way when not in use, as shown in FIG. 10, with the front of section B facing the front of section A, and the front of section C facing outward.

Figure 14:
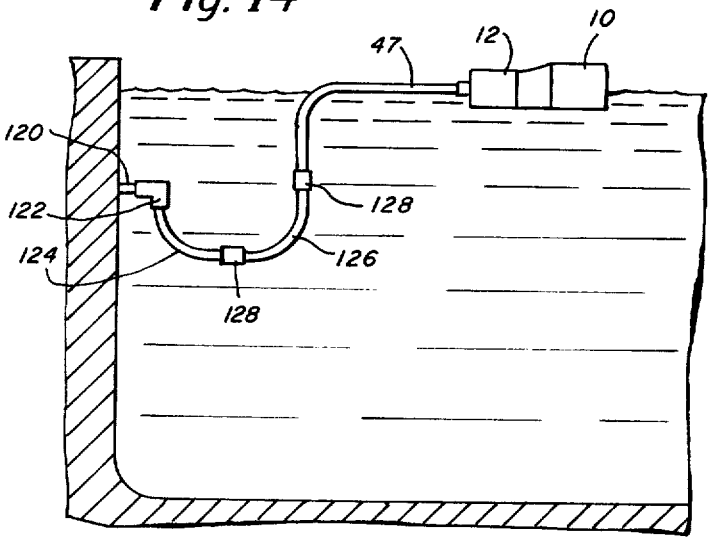

One or more swivel devices adapted for swimming pool cleaners should be used with the hose connecting the swimming pool tile cleaner to the water source. The swivel device is an attachment which rotatably connects two sections of hose. The swivel device should be attached near the water source to prevent the hose from tangling as the swimming pool tile cleaner circles around the pool along the sidewalls. For example, FIG. 14 illustrates, diagrammatically, a preferred arrangement for connecting the hose to the water source. As shown, the water inlet fitting 120 is provided with a connector 122 which, in turn, is connected to a pair of hose sections 124, 126. The hose sections 124, 126 are connected to each other by swivel connectors 128. As shown in FIG. 14, the arrangement defines a generally U-shaped configuration in which the initial hose segment 124 extends directly downwardly from the inlet fitting 120 and then defines a downwardly extending U-shaped configuration, but one which is freely swivelable and rotatable to enable the hose 47 to advance freely about the pool. This arrangement assures that no part of the hose 47 or the cleaning device will become entangled about itself or about the water inlet fitting 120.

It should be understood that the foregoing description of the invention is intended only to be illustrative and that modifications and adaptations of the design and construction of the above-described device and method for cleaning swimming pool tiles may occur to one skilled in the art without departing from the spirit of the invention.

Having described the invention, what is claimed is:

1. A device for cleaning the sidewall of a swimming pool in the region of the waterline comprising:

cleaning means for removing dirt from the waterline region of the sidewall of the pool, said waterline region including at least a portion of the sidewall which is above the waterline;

flotation means for providing sufficient positive buoyancy to maintain said cleaning means at said waterline region of the pool;

propulsion means for advancing the cleaning means horizontally along the water surface and along the sidewall of the pool at the waterline, thereby to clean the sidewall at said waterline region;

said cleaning means further comprising scrubbing means adapted to engage the pool sidewall in wiping contact and to clean the pool sidewall in response to advancement of the device along the sidewall.

2. A device as defined in claim 1 wherein the propulsion means is constructed also to urge the scrubbing means against the sidewall.

3. A device as in claim 1 wherein said propulsion means comprises:

inlet means to be connected to a pressurized flow of water, and at least one jet outlet means in communication with said inlet means, said jet outlet means facilitating propulsion of said device by the outward flow of water therefrom.

4. A device as in claim 3, having at least one jet outlet means for propelling said pool cleaner in a forward direction, and at least one jet outlet means for propelling said pool cleaner cleaner against the side walls of a pool vessel.

5. A device as defined in claim 3 wherein said jet outlet means is so constructed and arranged as to be adjustable directionally.

6. A device as in claim 3 having at least four of said jet outlet means, wherein each of said jet outlet means is arranged to propel the device in a forward direction while at the same time urging the device against the sidewall of the swimming pool.

7. A device for cleaning the sidewall of a swimming pool in the region of the waterline comprising:

cleaning means for removing dirt from the waterline region of the sidewall of the pool, said waterline region including at least a portion of the sidewall which is above the waterline;

floatation means for providing sufficient positive buoyancy to maintain said cleaning means at said waterline region of the pool;

propulsion means for advancing the cleaning means horizontally along the water surface and along the sidewall of the pool at the waterline, thereby to clean the sidewall at said waterline region;

said cleaning means comprising brushing means.

8. A device as in claim 7, wherein said brushing means comprises a plurality of bristles arranged to contact the sidewall of the pool as brush means are advanced under the influence of the propulsion means.

9. A device as in claim 7, further comprising a bumper means affixed to said device near the leading edge of said brushing means, said brushing means having bristles extending therefrom, said bumper means extending outward to the ends of said bristles.

10. A device as defined in claim 9 wherein the position of said bumper means is adjustable.

11. A device for cleaning the sidewall of a swimming pool in the region of the waterline comprising:

cleaning means for removing dirt from the waterline region of the sidewall of the pool, said waterline region including at least a portion of the sidewall which is above the waterline;

flotation means for providing sufficient positive buoyancy to maintain said cleaning means at said waterline region of the pool;

propulsion means for advancing the cleaning means horizontally along the water surface and along the sidewall of the pool at the waterline, thereby to clean the sidewall at said waterline region; and soap-dispensing means operating in conjunction with said cleaning means.

12. A device as in claim 11, wherein said soap-dispensing means comprises:

a soap chamber;

a water inlet means in communication with said soap chamber, said water inlet means to be connected to a pressurized flow of water;

an outlet means in communication with said soap chamber; and a dispenser means in communication with said outlet means.

13. A device as in claim 12, wherein said dispenser means comprises a tubular extension from said leading portion at said brush means so that said tubular extension extends vertically upward at least two inches above the waterline when said pool cleaner is in use, said tubular extension having a plurality of outlet holes for dispensing soap solution carried therethrough by said pressurized flow of water.

14. A device as in claim 12, said soap chamber having an opening through which concentrated soap can be placed into said soap chamber, said soap chamber opening having a removable cap means for sealing said opening.

15. A device as in claim 12, wherein said dispenser means is T-shaped.

16. A device for cleaning the sidewall of a swimming pool in the region of the waterline comprising:

cleaning means for removing dirt from the waterline region of the sidewall of the pool, said waterline region including at least a portion of the sidewall which is above the waterline;

flotation means for providing sufficient positive buoyancy to maintain said cleaning means at said waterline region of the pool;

propulsion means for advancing the cleaning means horizontally along the water surface and along the sidewall of the pool at the waterline, thereby to clean the sidewall at said waterline region; and filtration means carried by the device for filtering and collecting dirt removed by said cleaning means.

17. A device as in claim 16, wherein said filtration means has a suction means for drawing in water carrying the dirt particles to be filtered.

18. A device as in claim 16, wherein said filtration means comprises:

a filtration chamber located rearward of said cleaning means, said filtration chamber having a forward entrance opening and a rearward exit opening to accommodate the free flow of water therethrough, an inlet means to be connected to a pressurized flow of water, at least one jet outlet means in communication with said inlet means, said jet outlet means located forward of said filtration chamber so that said pressurized flow of water flows into said filtration system, said jet outlet means providing forward propulsion of said pool cleaner as well as a suction effect for drawing dirt particles into said filtration chamber, and a trapping means for trapping dirt particles which flow into said filtration chamber, said trapping means positioned in the path of the flow of water through said filtration chamber.

19. A device as in, claim 18, wherein said trapping means comprises a mesh filter membrane operatively positioned within said filtration chamber.

20. A device for cleaning the sidewall of a swimming pool in the region of the waterline comprising:

cleaning means for removing dirt from the waterline region of the sidewall of the pool;

flotation means for providing sufficient buoyancy to maintain said cleaning means at the waterline region of the pool;

propulsion means for advancing the cleaning means along the sidewall of the pool at the waterline;

said device further comprising a leading portion and a trailing portion;

said leading portion carrying the cleaning means;

said trailing portion carrying at least a portion of the propulsion means; and flexible connecting means connecting said leading means to said trailing means.

21. A device as in claim 20, further comprising a filtration means affixed to said trailing portion for filtering dirt removed by said cleaning means from said pool.

22. A device as in claim 20, wherein said cleaning means is comprised of brush means.

23. A device as in claim 22, wherein said brush means has a bristle surface wherein the leading portion of said bristle surface is at least partially curved at the forward end of said leading portion of said swimming pool cleaner.

24. A device as in claim 20, said propulsion means comprising:

an inlet means to be connected to a pressurized flow of water, and at least one jet outlet means in communication with said inlet means, said jet outlet means accommodating the outward flow of said pressurized flow of water, thereby propelling said pool cleaner in the opposite direction of said outward flow of water.

25. A device as in claim 24 having:

at least one jet outlet means for propelling said pool cleaner in a forward direction, and at least one jet outlet means for propelling said pool cleaner against the side walls of a pool vessel.

26. A device as in claim 25, further comprising:

at least one of said jet outlet means for forward propulsion located on each of said leading and trailing portions of said pool cleaner, and at least one of said jet outlet means for side propulsion located on each of said leading and trailing portions of said pool cleaner.

27. A device as in claim 26, wherein said flexible connecting means comprises at least one bendable inlet tube for accommodating said pressurized flow of water for said jet outlet means between said trailing and leading portions of said pool cleaner.

28. A device as in claim 24, wherein said jet outlet means is so constructed and arranged to be adjustable directionally.

29. A device as in claim 20, further comprising a soap-dispensing means operating in conjunction with said cleaning means.

30. A device as in claim 29, wherein said soap-dispensing means comprises:

a soap chamber;

a water inlet means in communication with said soap chamber, said water inlet means to be connected to a pressurized flow of water;

an outlet means in communication with said soap chamber; and a dispenser means in communication with said outlet means.

31. A device as in claim 20 having water inlet means extending from the trailing portion at an angle to the lengthwise dimension of the trailing portion.

32. A device for cleaning the sidewall of a swimming pool in the region of the waterline comprising:

A. A leading portion comprising:

1. a brush means for brushing the side walls of a pool vessel, thereby facilitating removal of dirt from said side walls;
2. fluid inlet means to be connected to a pressurized flow of water;
3. at least one jet outlet means in communication with said inlet means, said jet outlet means accommodating the outward flow of said pressurized flow of water thereby propelling said pool cleaner in the opposite direction of said outward flow of water; and
4. floatation means providing sufficient buoyancy to maintain said leading portion at the waterline when in use;

B. A trailing portion comprising:

1. filtration means for filtering dirt removed by said brush means from said side walls;
2. fluid inlet means to be connected to a pressurized flow of water;
3. at least one jet outlet means in communication with said inlet means, said jet outlet means accommodating the outward flow of pressurized flow of water, thereby propelling said pool cleaner in the opposite direction of said outward flow of water;

4. flotation means providing sufficient buoyancy to maintain said trailing portion at the waterline when in use; and
5. rolling means for facilitating travel of said trailing portion along the side walls of a pool vessel; and C. A flexible connecting means comprising at least one bendable water inlet tube, one end of said inlet tube being in communication with said inlet means of said inlet portion, the other end of said inlet tube being in communication with said trailing portion, said water inlet tube accommodating a pressurized flow of water from said trailing means to said leading means, said flexible connecting means allowing said pool cleaner to bend at an angle sufficient to allow said pool cleaner to follow the angles of the sidewalls of a pool.

33. A system for cleaning the sidewall of a swimming pool at the waterline region comprising:

a cleaning element including cleaning means for removing dirt from the waterline region of the sidewall of the pool, said waterline region including at least a portion of the sidewall which is above the waterline;

means for supporting the cleaning element for advancement along the sidewall of the swimming pool at the region of the water line, said supporting and advancement means comprising flotation means for providing sufficient positive buoyancy to maintain said cleaning means at said waterline region of the pool, and propulsion means for advancing the cleaning means horizontally along the water surface and along the sidewall of the pool at the waterline, thereby to clean the sidewall at said waterline region;

said pool having at least one skimmer opening in the sidewall of the pool at the region of the waterline; and means located at the skimmer opening to facilitate advancement of the cleaning element past the skimmer opening, said means being constructed and arranged to dislodge dirt particles from the cleaning means in response to advancement of the cleaning means past the skimmer opening.

* * * * *